US005273394A

United States Patent [19]

Samuel

[11] Patent Number: 5,273,394

[45] Date of Patent: Dec. 28, 1993

[54] TURBINE PUMP

[75] Inventor: Christopher J. Samuel, Auburn, Mich.

[73] Assignee: General Motors Corporation, Detroit, Mich.

[21] Appl. No.: 949,916

[22] Filed: Sep. 24, 1992

[51] Int. Cl.[5] ..... F04D 5/00

[52] U.S. Cl. ..... 415/55.1; 415/55.4

[58] Field of Search ..... 415/55.1, 55.2, 55.4, 415/55.5

[56] References Cited

U.S. PATENT DOCUMENTS

| | | | |
|---|---|---|---|
| 1,875,419 | 9/1932 | Claypool . | |
| 2,696,789 | 12/1954 | Fabig | 103/113 |
| 3,676,025 | 7/1972 | Shultz et al. | 417/423 |
| 3,881,839 | 5/1975 | MacManus . | |
| 3,947,149 | 3/1976 | MacManus . | |
| 4,209,284 | 6/1980 | Lochmann et al. | 417/366 |
| 4,408,952 | 10/1983 | Schweinfurter . | |
| 4,734,008 | 3/1988 | Roth . | |
| 5,022,830 | 6/1991 | Weber et al. | 417/423.14 |

FOREIGN PATENT DOCUMENTS

| | | | |
|---|---|---|---|
| 689067 | 9/1930 | France | 415/55.1 |
| 1071992 | 9/1954 | France | 415/55.1 |
| 1331429 | 5/1963 | France | 415/55.2 |
| 206795 | 12/1982 | Japan | 415/55.2 |
| 186095 | 8/1987 | Japan | 415/55.5 |
| 31365 | 4/1961 | Sweden | 415/55.1 |

*Primary Examiner*—John T. Kwon
*Attorney, Agent, or Firm*—Saul Schwartz

[57] ABSTRACT

A regenerative turbine fuel pump for motor vehicles including a flat disc-shaped impeller having radial vanes in an annular pump chamber, the pump having strippers in the pump chamber oriented obliquely relative to the direction of rotation of the vanes and inlet and discharge ports disposed generally at the apexes of wedge-shaped ends of the pump chamber grooves defined by the oblique sides of the strippers. The vanes are progressively covered and uncovered by the oblique sides of the strippers as the vanes enter and leave the confines of the strippers to attenuate pressure pulses and minimize audible tones associated with such pressure pulses.

5 Claims, 2 Drawing Sheets

TURBINE PUMP

FIELD OF THE INVENTION

This invention relates to regenerative turbine fuel pumps for motor vehicles.

BACKGROUND OF THE INVENTION

Regenerative turbine pumps, commonly used as fuel pumps in motor vehicles, are characterized by a disc-shaped impeller the periphery of which is enclosed in an annular pump chamber defined by a stationary housing enclosing the impeller. The depth and outside diameter of the pump chamber exceed the depth and diameter of the impeller. Radial vanes around the periphery of the impeller induce fluid flow in the pump chamber in regenerative fashion in the direction of rotation of the impeller from an inlet port toward a discharge port while boosting the pressure of the fluid. The annular pump chamber is interrupted by portions of the stationary housing, commonly called strippers, extending to near the planar sides and the circumference of the impeller. The strippers separate the inlet and discharge ports of the pump. As the vanes enter and leave the confines of the strippers, pressure pulses are generated which, because of the high rotational speed of the impeller, may create audible tones. A regenerative turbine pump according to this invention incorporates novel features for minimizing such audible tones.

SUMMARY OF THE INVENTION

This invention is a new and improved regenerative turbine fuel pump of the type including a disc-shaped impeller the periphery of which is enclosed in an annular pump chamber having an inlet port and a discharge port, radial vanes around the impeller in the pump chamber, and strippers between the inlet and discharge ports extending to closely adjacent the planar sides and the circumference of the impeller. In the pump according to this invention, the edges of the strippers are oriented relative to the corresponding edges of the vanes on the impeller such that the ends of the pump chamber are wedge-shaped so that the edges of the vanes are progressively covered and uncovered by the strippers to attenuate pressure pulses and minimize audible tones. The inlet and discharge ports of the pump chamber extend to the apexes of the wedge-shaped ends of the pump chamber for maximum pressure pulse attenuation.

DESCRIPTION OF A PREFERRED EMBODIMENT

Figure 1:
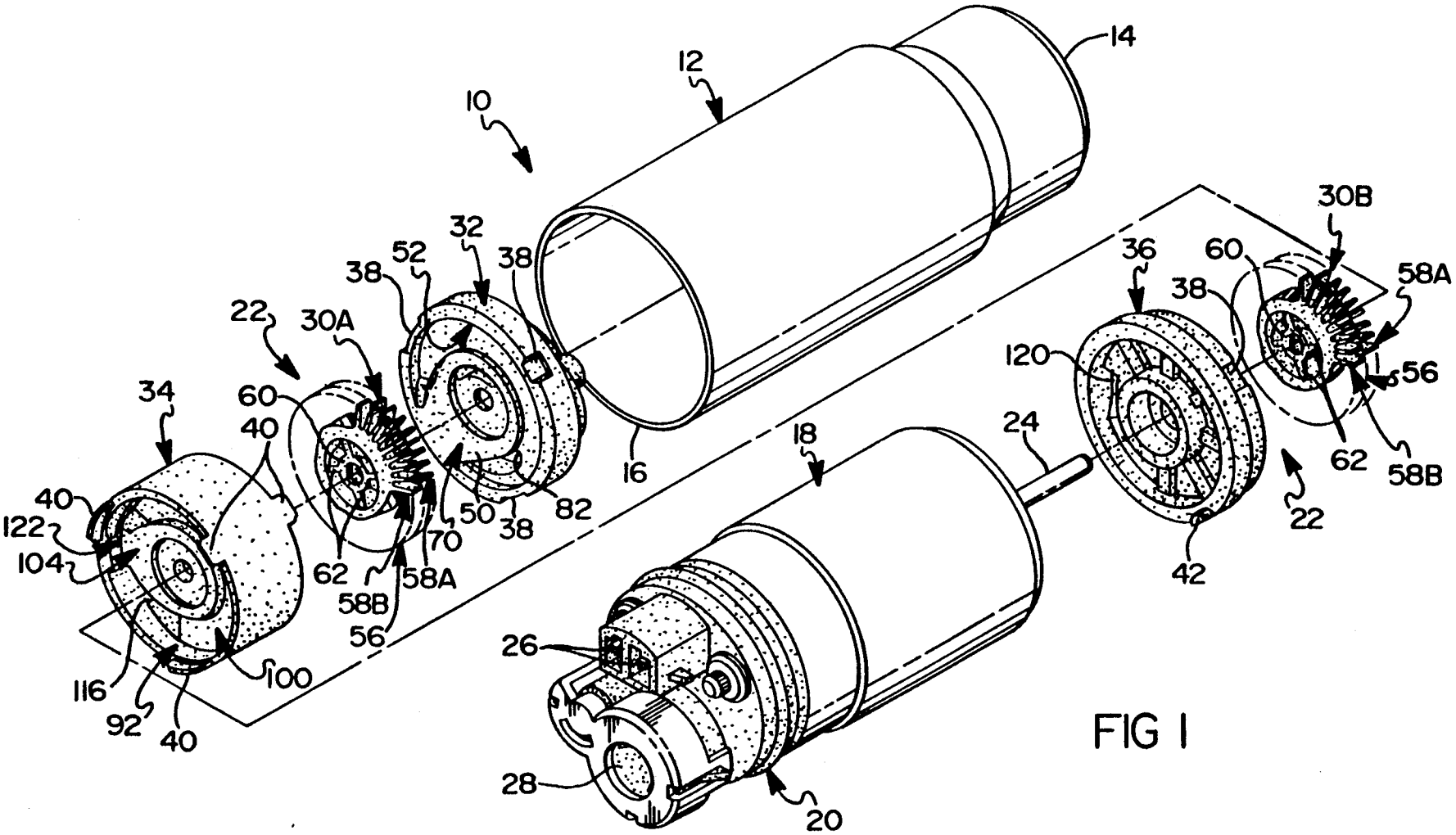
FIG. 1 is an exploded perspective view of a motor vehicle fuel pump assembly including a regenerative turbine pump according to this invention.

Referring to FIG. 1, a motor vehicle fuel pump assembly 10 includes a thin-walled tubular metal shell 12 having a first end 14 and a second end 16, a discrete electric motor 18, an end cap 20, and a two stage regenerative turbine fuel pump 22 according to this invention. The fuel pump 22 and the end cap 20 are disposed in the shell 12 and close, respectively, the first and second ends 14,16. The motor 18 is disposed in the shell between the pump 22 and the end cap 20 and includes an armature shaft 24. The motor is turned on and off by a wiring harness of the vehicle, not shown, connected to the fuel pump assembly 10 at a terminal 26 on the end cap 20. Fuel discharges from the pump assembly through a connector 28 on the end cap.

Figure 2:
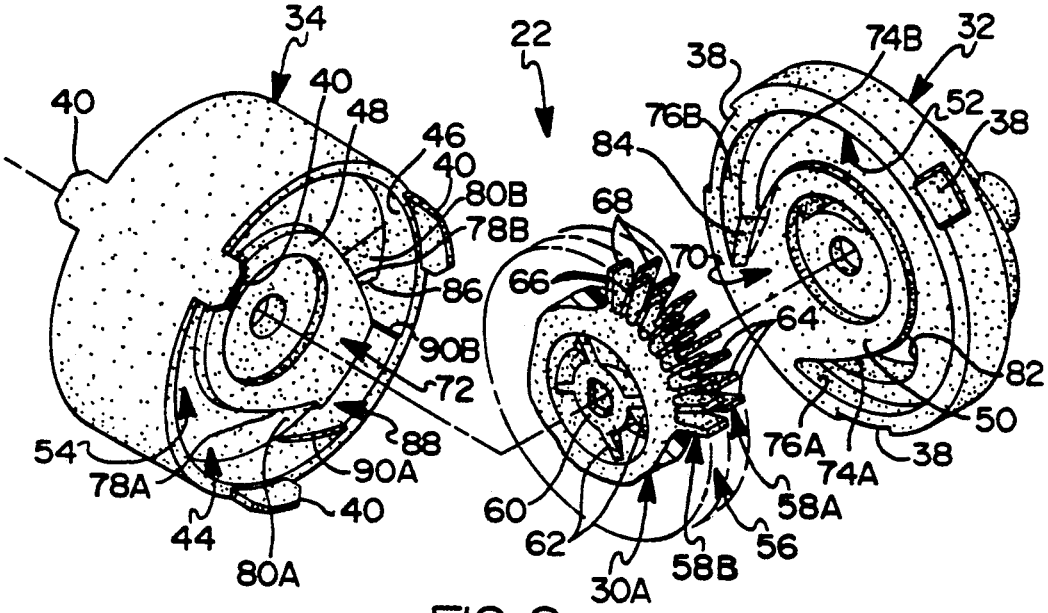
FIG. 2 is an exploded perspective view of a portion of FIG. 1.
Figure 3:
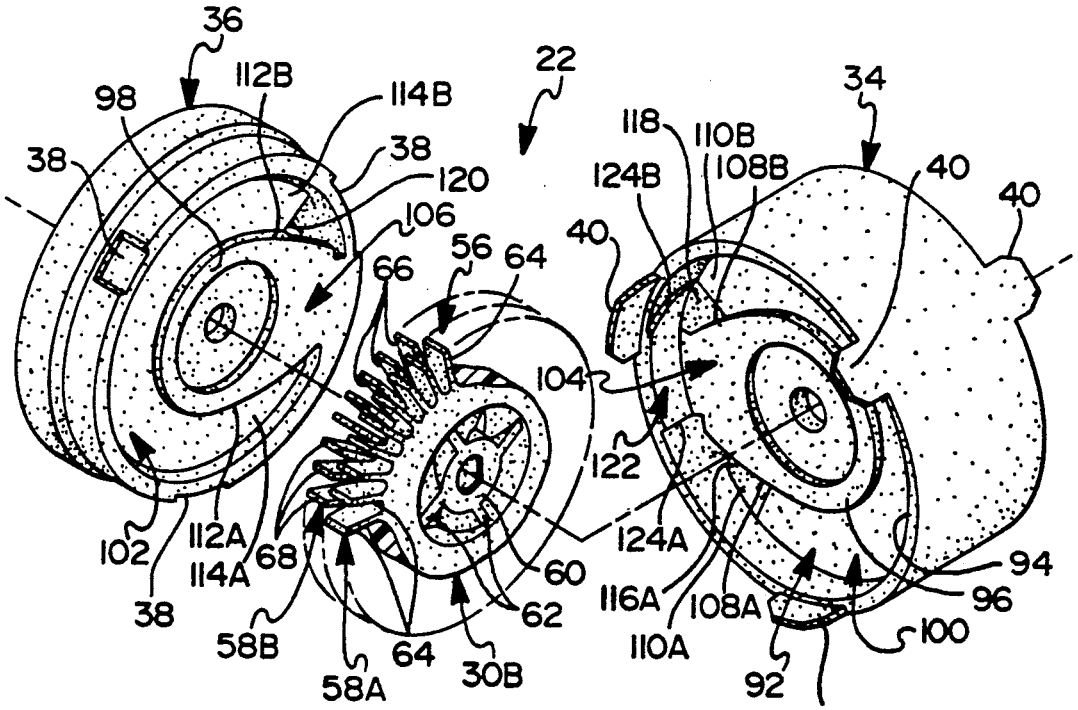
FIG. 3 is an exploded perspective view of another portion of FIG. 1.

Referring to FIGS. 1-3, the turbine pump 22 according to this invention includes a cylindrical, multi-piece housing and a pair of disc-shaped rotors or impellers 3OA-B. In the preferred embodiment, the impellers 3OA-B are identical and, accordingly, the features of each are identified by the same reference characters. However, it is contemplated that the impellers need not be identical.

The pump housing consists of an inlet body 32, a center body 34, and a discharge body 36 all interconnected by a plurality of notches 38 and tangs 40 for precise angular orientation of the bodies 32-36 relative to each other and for torque reaction. The discharge body 36 is keyed to the discrete motor 18 by a tang 42, FIG. 1, to react torque between the motor and the turbine pump 22.

The impeller 30A is disposed in a first cavity 44, FIG. 2, in the center body 34 defined by a cylindrical wall 46 and an inside face 48 of the center body. The inlet body 32 closes the open side of the cavity 44 and the impeller 30A is captured in the cavity 44 by an inside face 50 of the inlet body. An annular groove 52 in the inside face 50 of the inlet body 32 cooperates with a corresponding annular groove 54 in the inside face 48 of the center body 34 in defining a first pump chamber surrounding the periphery of the first impeller 30A.

The first impeller 30A has a plurality of integral, open-style impeller vanes 56 defining a pair of angularly offset vane stages 58A-B as described in U.S. patent application Ser. No. 07/907,999, filed Jul. 2, 1992 and assigned to the assignee of this invention. The impeller 30A further includes a hub 60 connected to the remainder of the impeller through a plurality of radial spokes 62 defining blades of a vapor ejecting fan as described in U.S. Pat. No. 4,734,008, issued Mar. 29, 1988 and assigned to the assignee of this invention. It is contemplated that impellers with open-style vanes as described in U.S. Pat. No. 3,418,991, issued Dec. 31, 1968 and assigned to the assignee of this invention, or closed-style vanes, as describe in U.S. Pat. No. 2,965,038, may also be used.

In the planes of the parallel sides of the impeller 30A, the vanes in stage 58A each have a radial edge 64 and the vanes in stage 58B each have a radial edge 66. Around the circumference of the impeller 30A, each of the vanes in both stages has an outer edge 68. The vanes 56 are all disposed in the first pump chamber defined by the grooves 52,54 with the radial edges 64,66 spaced from the bottoms of the corresponding grooves 52,54 and the outer edges 68 spaced from the cylindrical wall 46 of the cavity 44.

Each of the grooves 52,54 is interrupted by an integral portion of the inlet and center bodies 32,34, respectively, extending close to the corresponding planar sides of the impeller 30A and defining respective ones of a pair of strippers 70,72 on the inlet and center bodies 32,34. The stripper 70 has a pair of sides 74A-B, FIG. 2, which extend obliquely relative to the direction of movement of the vanes 56 from the inside diameter of the groove 52 toward the outside diameter thereof and define a pair of wedge-shaped ends 76A-B of the groove 52. The stripper 72 has a corresponding pair of sides 78A-B which define a corresponding pair of wedge-shaped ends 8OA-B of the groove 54.

The inlet body 32 has an inlet port 82, FIG. 2, intersecting the groove 52 at the apex of the wedge-shaped end 76A of the groove. The other wedge-shaped end 76B of the groove 52 terminates at a ramp 84 which rises from the bottom of the groove to the plane of the inside face 50 of the inlet body. The center body 34 has a discharge port 86, FIG. 2, intersecting the groove 54 at the apex of the wedge-shaped end 80B of the groove.

As seen best in FIG. 2, the cylindrical wall 46 around the cavity 44 in the center body 34 is interrupted by an integral portion of the center body projecting close to the circumference of the impeller 30A and defining a stripper 88 extending across the first pump chamber. The stripper 88 has a first edge 90A which extends obliquely relative to the direction of movement of the impeller vanes 56 and a second edge 90B which extends transversely. The first edge 90A is located relative to the wedge-shaped ends 76A,80A of the grooves 52,54 such that the widest part of the stripper 88 coincides with apexes of the wedges. The second edge 90B is located relative to the wedge-shaped ends 76B,80B of the grooves 52,54 such that the edge 90B coincides with apexes of the wedges.

The armature shaft 24 of the electric motor 18 projects through the discharge and center bodies 36,34 and is drivingly connected to the hub 60 of the first impeller 30A. When the electric motor is turned on, the armature shaft 24 rotates the first impeller 30A at high speed in the first pump chamber to induce fluid flow in the first pumping chamber in regenerative pump fashion from the inlet port 82 to the discharge port 86.

In operation, as each of the vanes 56 emerges from within the confines of the strippers 70,72, the edges 64,66 of the vanes are progressively uncovered as the impeller rotates through an included angle corresponding to the projected lengths of the sides 74A,78A of the strippers in the direction of movement of the vanes 56. Likewise, as each of the vanes 56 emerges from within the confines of the stripper 88, the outer edges 68 of the vanes are progressively uncovered as the impeller rotates through an included angle corresponding to the projected length of the oblique edge 90A of the stripper in the direction of movement of the vanes. Progressive uncovering of the edges of the vanes as they emerge from the confines of the strippers reduces pressure pulsations near the inlet port 82 and minimizes audible tones attributable to such pulsations.

Similarly, as each of the vanes 56 passes the discharge port 86 and enters the confines of the strippers 70,72, the edges 64,66 of the vanes are progressively covered by the sides 74B,78B of the strippers as the impeller rotates through an included angle corresponding to the projected lengths of the sides of the strippers in the direction of movement of the vanes. Such progressive covering of the edges of the vanes reduces pressure pulsations near the discharge port 86 and minimizes audible tones attributable to such pulsations.

It is contemplated that manufacturing constraints and economies may dictate that not every side of each stripper in a particular pump according to this invention be oriented for progressive covering or uncovering of corresponding edges of the vane. The transverse side 90B of the stripper 88, for example, effects abrupt rather than progressive covering of the outer edges 68 of the vanes as each enters the confines of the stripper.

The regenerative turbine pump 22 according to this invention has a second stage similar to the first stage just described. Referring to FIG. 3, a second cavity 92 in the center body 34 is defined by a cylindrical wall 94 and an inside face 96. The second impeller 30B is disposed in and captured in the cavity 92 by an inside face 98 of the discharge body 36 which discharge body closes the open side of the cavity 92. An annular groove 100 in the inside face 96 of the center body 34 cooperates with a corresponding annular groove 102 in the inside face 98 of the discharge body 36 in defining a second pump chamber around the periphery of the second impeller 30B.

The grooves 100,102 are interrupted by integral portions of the center and discharge bodies 34,36, respectively, defining corresponding ones of a pair of strippers 104,106. The stripper 104 has a pair of sides 108A-B, FIG. 3, which extend obliquely relative to the direction of movement of the vanes 56 from the inside diameter of the groove 100 toward the outside diameter thereof and define a pair of wedge-shaped ends 11OA-B of the groove. The stripper 106 has a corresponding pair of sides 112A-B which define a corresponding pair of wedge-shaped ends 114A-B of the groove 102.

The center body 34 has an inlet port 116, FIG. 3, intersecting the groove 100 at the apex of the wedge-shaped end 110A of the groove. The inlet port 116 is connected to the discharge port 86 of the first pump chamber on the other side of the center body 34. The wedge-shaped end 110B of the groove 100 has a ramp 118 which rises from the bottom of the groove to the plane of inside face 96 of the center body to close the groove at the inside face. The discharge body 36 has a discharge port 120, FIG. 3, intersecting the groove 102 at the apex of the wedge-shaped end 114B of the groove. The discharge port 120 is open to the interior of the shell 12 of the pump assembly.

As seen best in FIG. 3, the cylindrical wall 94 around the cavity 92 in the center body 34 is interrupted by an integral portion of the center body projecting close to the circumference of the second impeller 30B and defining a stripper 122 extending across the second pump chamber. The stripper 122 has a first edge 124A which extends transversely and a second edge 124B which extends obliquely relative to the direction of movement of the vanes 56. The first edge 124A is located relative to the wedge-shaped ends 110A,114A of the grooves 100,102 such that the edge 124A coincides with apexes of the wedge-shaped ends. The second edge 124B is located relative to the wedge-shaped ends 110B,114B of the grooves 100,102 such that the widest part of the stripper 122 coincides with apexes of the wedge-shaped ends.

The armature shaft 24 of the electric motor 18 projects through the discharge body 36 and is drivingly connected to the hub 60 of the second impeller 30B. When the motor is turned on, the armature shaft rotates the second impeller at high speed in the second pump chamber to induce fluid flow in regenerative pump fashion in the second pump chamber from the inlet port 116 to the discharge port 120. The sides of the strippers 104,106,122 cooperate with the edges of the vanes 56 as described above to reduce pressure pulsations and consequent audible noise emanating from the second stage of the turbine pump 22.

I claim:

1. A regenerative turbine pump comprising:

a housing, means on said housing defining a generally cylindrical cavity having a cylindrical wall and a first planar inside face and a second planar inside face, means defining a first annular groove in said first inside face and a second annular groove in said second inside face cooperating with said first annular groove and with said cylindrical wall in defining an annular pump chamber in said housing, a flat disc-shaped impeller rotatably supported on said housing having a periphery disposed in said annular pump chamber, means defining a plurality of vanes around the periphery of said impeller in said annular pump chamber, each of said vanes having a radial edge in a planar side of said flat impeller and an outer edge in the circumference of said impeller, means on said housing defining a first stripper in said first inside face interrupting said first annular groove and including a pair of sides extending obliquely relative to the direction of movement of said vanes so that said first annular groove has a pair of wedge-shaped ends, means on said housing defining a second stripper in said second inside face interrupting said second annular groove and including a pair of sides extending obliquely relative to the direction of movement of said vanes so that said second annular groove has a pair of wedge-shaped ends, and means on said housing defining an inlet port generally at the apex of one of said pair of wedge-shaped ends of one of said first and said second annular grooves and a discharge port generally at the apex of another one of said pair of wedge-shaped ends of one of said first and said second annular grooves.

2. The turbine pump recited in claim 1 wherein:

said inlet port is at the apex of one of said pair of wedge-shaped ends of said first annular groove, and said discharge port is at the apex of one of said pair of wedge-shaped ends of said second annular groove.

3. The turbine pump recited in claim 2 and further including:

means defining a third stripper on said housing in said pump chamber interrupting said cylindrical wall and having a side extending obliquely relative to the direction of movement of said impeller vanes.

4. The turbine pump recited in claim 3 wherein said turbine pump is a motor vehicle fuel pump.

5. The turbine pump recited in claim 4 wherein said vanes on said impeller are open-style vanes.

* * * * *